United States Patent [19]

Heyne

[11] Patent Number: 4,555,972

[45] Date of Patent: Dec. 3, 1985

[54] ELECTROMAGNETIC LAUNCHER WITH POWDER DRIVEN PROJECTILE INSERTION

[75] Inventor: Carl J. Heyne, Hampton Township, Allegheny County, Pa.

[73] Assignee: Westinghouse Electric Corp., Pittsburgh, Pa.

[21] Appl. No.: 451,566

[22] Filed: Dec. 20, 1982

[51] Int. Cl.[4] ..... F41F 1/02

[52] U.S. Cl. ..... 89/8; 124/3; 310/12

[58] Field of Search ..... 89/8, 14.05; 124/3; 310/10, 13, 12; 200/8 A, 144 R, 151; 318/135; 42/78

[56] References Cited

U.S. PATENT DOCUMENTS

| | | | |
|---|---|---|---|
| 755,165 | 3/1904 | Peck | 200/151 |
| 1,116,871 | 11/1914 | Bliss | 200/144 R |
| 1,298,447 | 3/1919 | Bradford | 89/8 |
| 1,370,200 | 3/1921 | Fauchon-Villepleé | 124/3 |
| 1,421,435 | 7/1922 | Fauchon-Villepleé | 124/3 |
| 1,959,737 | 5/1934 | Rigsby | 89/8 X |
| 1,985,254 | 12/1934 | Huse | 89/8 X |
| 2,870,675 | 1/1959 | Salisbury | 89/8 |
| 3,431,816 | 3/1969 | Dale | 89/8 |
| 3,503,300 | 3/1970 | Dardick | 89/8 |
| 4,126,955 | 11/1978 | Coffield et al. | 42/78 |
| 4,343,223 | 8/1982 | Hawke et al. | 89/8 |
| 4,347,463 | 8/1982 | Kemeny et al. | 310/10 |
| 4,376,406 | 3/1983 | Black | 89/8 X |
| 4,426,562 | 1/1984 | Kemeny | 200/8 A |
| 4,429,612 | 2/1984 | Tidman et al. | 89/8 |
| 4,433,607 | 2/1984 | Kemeny | 89/8 |
| 4,449,441 | 5/1984 | McAllister | 89/8 |

OTHER PUBLICATIONS

U.S. application Ser. No. 399,510, assigned to Westinghouse.

*Primary Examiner*—David H. Brown
*Assistant Examiner*—John E. Griffiths
*Attorney, Agent, or Firm*—R. P. Lenart

[57] ABSTRACT

An electromagnetic projectile launching system is provided with an electromagnetic launcher portion and a chemically driven launcher portion. The electromagnetic launcher portion includes a pair of generally parallel conductive rails, a source of high current connected to the rails, and means for conducting current between the rails and for propelling a projectile along the rails. The powder driven portion includes a rifled barrel adjacent one end of the conductive rails and axially aligned with the conductive rails, and means for chemically propelling a projectile through the rifled barrel and into the bore of the electromagnetic launcher portion while causing the projectile to spin prior to its entry into the bore.

1 Claim, 3 Drawing Figures

ELECTROMAGNETIC LAUNCHER WITH POWDER DRIVEN PROJECTILE INSERTION

BACKGROUND OF THE INVENTION

This invention relates to electromagnetic projectile launching systems and more particularly to such systems in which initial projectile acceleration occurs within a conventional rifled bore and additional acceleration is provided by electromagnetic forces.

Electromagnetic projectile launchers are known which comprise a pair of conductive rails, a sliding conductive armature between the rails, a source of high current and a switch for commutating this current into the rails and through the armature. Current flow through the rails and armature results in an electromagnetic force on the armature which propels it along the conductive rails. Launchers which utilize a sliding metallic armature have experienced considerable rail damage caused by the sliding armature, particularly where high armature velocities are involved. In these cases, a plasma or arc armature may be more suitable.

The principal disadvantage to the use of a plasma propelling armature has been the damage that occurs to the breech section of the launcher rails during formation of the plasma. Once the plasma is moving, very little, if any, damage occurs to the rails. Because the mass ratio between a projectile and a plasma armature is greater than that between a projectile and a sliding metallic armature, more efficient utilization of available launch package energy is possible with plasma drive. Therefore, the application of plasma driven projectiles in multi-shot systems is appropriate. Such systems include rapid-fire air defense systems and impact fusion reactors.

Several methods have been suggested for initiating a plasma or arc in electromagnetic launcher systems. These procedures are primarily directed toward resolving the problem of creating the plasma armature and minimizing the resulting thermal damage of the launcher rails. Ablation of the rail surfaces is caused by a slow moving or stationary arc and occurs during initial acceleration of the projectile from zero velocity. At higher projectile velocities, the effects of this thermal phenomenon become increasingly insignificant. Therefore a means for imparting initial momentum to the launch package is desired to prolong launcher rail life.

The present invention utilizes conventional rapid-fire powder gun technology to rapidly load and fire projectiles into an electromagnetic launcher bore which continues to accelerate the powder driven projectile to velocities in excess of those attainable with conventional gun powder technology. This electromagnetic launcher system exploits the inherent advantages of both the powder driven and electromagnetic launchers to produce a high repetition rate launcher with superior performance characteristics.

SUMMARY OF THE INVENTION

An electromagnetic projectile launcher system constructed in accordance with the present invention comprises:

a pair of generally parallel conductive projectile launching rails lining a bore;

a source of high current connected to the conductive rails;

means for conducting current between the conductive rails and for propelling a projectile along the rails;

a rifled barrel disposed adjacent to one end of the conductive rails and axially aligned with the conductive rails;

means for electrically insulating the barrel and the rails; and means for propelling the projectile through the rifled barrel and into the bore, thereby causing the projectile to spin prior to its entry into the bore. The rifled barrel may be constructed using conventional powder driven gun technology and can be used with conventional high-speed reloading mechanisms to produce a rapid fire launching system. The projectile is spin stabilized prior to its entry into the electromagnetic launcher bore. By providing the projectile with a bore sealing sabot and using a chemical propellant for the initial projectile acceleration, the initial chemical explosion can provide a low resistance gas for initiation of a plasma armature in the electromagnetic launcher bore section.

DESCRIPTION OF THE PREFERRED EMBODIMENT

Figure 1:
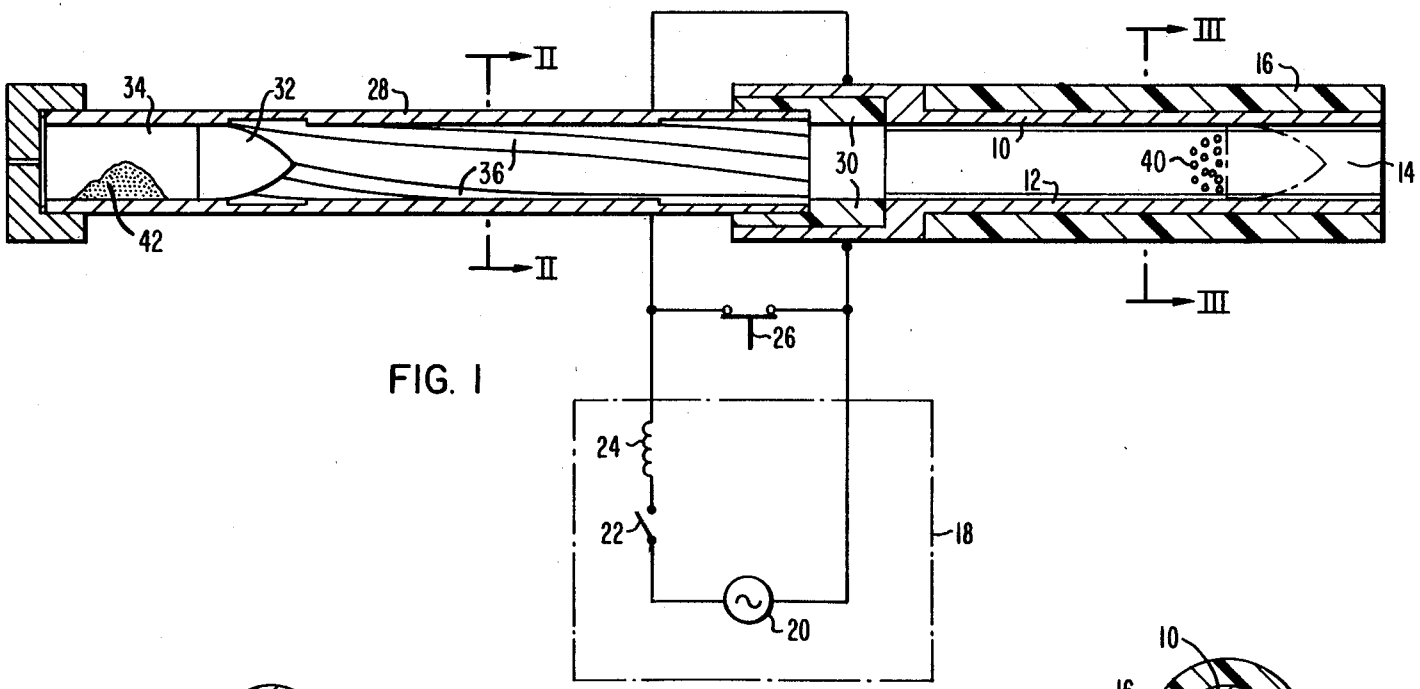
FIG. 1 is a schematic diagram of an electromagnetic projectile launcher in accordance with one embodiment of the present invention.

Referring to the drawings, FIG. 1 is a schematic diagram of an electromagnetic projectile launching system in accordance with one embodiment of the present invention. A pair of generally parallel conductive projectile launching rails 10 and 12 line an electromagnetic projectile launcher bore 14 and are restrained within support structure 16. These projectile launching rails are electrically connected to a source of high current 18 which in this embodiment comprises the series connection of a direct current generator 20, a switch 22 and an inductive energy storage means 24. A commutating switch 26 is connected across the projectile launching rails to provide a path for current which charges the inductive energy storage means 24 prior to electromagnetic acceleration of a projectile. Switch 26 may be of the type disclosed in a copending commonly assigned application entitled "Rotary Switch For Switching Very Large DC Currents," assigned Ser. No. 309,289, filed Oct. 6, 1981 by Kemeny, now U.S. Pat. No. 4,426,562 and hereby incorporated by reference. A rifled barrel 28 is disposed adjacent to one end of conductive rails 10 and 12 and axially aligned with the bore 14 between these rails. Insulation 30 serves as a means for electrically insulating the barrel 28 from conductive rails 10 and 12. A projectile 32 and its associated chemical propellant cartridge 34 are inserted into the breech of barrel 28.

Figure 2:
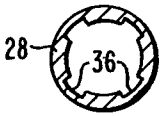
FIG. 2 is a cross-section of the rifled barrel of the launcher system of FIG. 1 taken along line II—II.

FIG. 2 is a cross-section of barrel 28 of FIG. 1 taken along line II—II. Rifling grooves 36 are cut into barrel 28 and spiral along the barrel axis to spin stabilize projectile 32 as it passes through the barrel in accordance with known technology.

Figure 3:
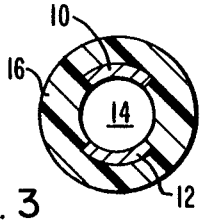
FIG. 3 is a cross-section of the electromagnetic launcher portion of the launcher system of FIG. 1 taken along line III—III.

FIG. 3 is a cross-section of the electromagnetic launcher portion of the launching system of FIG. 1 taken along line III—III. Projectile launching rails 10 and 12 can be seen to have an arcuate surface lining bore 14. During a launch, the spinning projectile continues to spin while being further accelerated within the electromagnetic portion of the launching system.

The projectile 32 in cartridge 34 of FIG. 1 must include an electrically non-conductive sabot to prevent the transfer of current through the projectile during acceleration in the electromagnetic launcher portion of the launching system. The use of non-conductive sabots is a common and well-developed practice in use in high velocity powder driven guns. The use of a conventional powder driven gun to provide the force or initial projectile acceleration takes advantage of the excellent performance of chemically driven guns at lower projectile velocities. Traditional powder gun technology allows the projectile to be spin stabilized before entering the round bore of the electromagnetic launcher portion for improved accuracy and, in addition, allows the projectile to be introduced into the electromagnetic launcher portion at a substantial velocity. This will significantly reduce the size of the electromagnetic launcher drive components since the electromagnetic force need only boost the velocity of the projectile instead of supplying the entire accelerating force. In addition, the launcher takes full advantage of the unsurpassed ability of powder propellants to provide high acceleration forces with minimum weight and volume, while achieving projectile velocities in excess of the limit for powder propellant driven projectiles.

Introduction of the projectile into the electromagnetic launcher bore at a high velocity, for example 1 kilometer per second, will substantially improve the life of the electromagnetic launcher's conductive rails. Tests have shown that little rail damage occurs with a plasma armature once the projectile achieves a velocity of approximately 100 meters per second. In the embodiment of FIG. 1, the plasma produced by the chemical explosion in the powder driven gun portion is injected into the bore of the electromagnetic launcher portion behind the projectile and can provide a low resistance gas for initiation of a plasma armature to electromagnetically accelerate the projectile. Insulation 30 at the end of the powder gun barrel 28 electrically insulates the conductive barrel from the conductive rails of the electromagnetic launcher portion while simultaneously providing a seal to contain the expanding gases from the powder explosion and guiding the projectile into the electromagnetic launcher bore.

The electromagnetic launcher portion of the launching system comprises a high current source 18, a switch 26 which applies electrical powder to the electromagnetic launcher rails at the appropriate time and a pair of generally parallel conductive rails which conduct current to an armature behind the projectile and form a one-turn linear motor to accelerate the projectile. A variety of high current sources can be used, including capacitors, or a homopolar generator and inductor coil. The launching system illustrated in FIG. 1 shows a homopolar generator 20 and an inductive energy storage coil 24. The homopolar generator stores energy in the rotating mass of its rotor which, upon closing the switch, is delivered to the inductor. The inductor stores the energy in a magnetic field and upon opening switch 26 develops a voltage which commutates the current into the conductive rails of the electromagnetic launcher portion and delivers the energy to the projectile. Proper timing and sequencing of the switching operation with the conventional powder gun will allow the electromagnetic launcher portion of the launcher system to accelerate the projectile which has been fired from the powder gun into the breech of the electromagnetic launcher portion.

One method of accomplishing this timing is to use hot gases resulting from the chemical explosion in the powder driven gun to initiate conduction in the bore of the electromagnetic launcher portion in the form of a plasma armature 40. The sequence of events which would effect this mode of operation are as follows:

(1) Switches 22 and 26 are closed, thereby allowing homopolar generator 20 to charge inductive energy storage means 24.

(2) The projectile 32 which has been loaded into the powder gun portion of the launching system is accelerated by the ignition of a powder propellant 42 in cartridge 34. The firing of this cartridge is synchronized with the operation of switch 26.

(3) Switch 26 is opened, thereby causing a voltage to be developed across inductive energy storage means 24 and projectile launching rails 10 and 12.

(4) The projectile and hot gases from the burning propellant enter the breech of the electromagnetic launcher portion as the voltage developed between the rails reaches a value sufficiently high to initiate breakdown in the gas following the projectile.

(5) An arc is initiated behind the projectile in the electromagnetic launcher bore which completes the circuit and allows current to flow through the inductor, along the electromagnetic launcher rails, through the plasma armature 40 behind the projectile, through the homopolar generator and back to the inductor.

(6) This current flow causes the projectile to be accelerated electromagnetically and to achieve very high velocities.

(7) Switch 26 is closed as the projectile exits from bore 14 of the electromagnetic launcher portion and begins to charge the inductor for the next round. Simultaneously, a conventional powder gun reloading mechanism ejects the spent cartridge 34 and loads a live round. The sequencing of the loading and firing mechanism is controlled by a mechanical or electrical linkage between the loading and firing mechanism of the powder gun portion and switch 26. It can be seen that an electromagnetic projectile launching system constructed in accordance with this invention provides for: the attainment of high projectile velocities; spin stabilization of projectiles; utilization of well developed rapid fire and loading technology; and use of available projectile technology.

In addition to the firing sequence described with respect to the preferred embodiment of FIG. 1, there are several other methods which can be used to synchronize the firing of the powder and electromagnetic launcher portions of the launching system to provide a conductive armature for electromagnetic launcher portion operation. These methods include:

(1) providing a metallic armature on the rear of the projectile to initiate current conduction in the electromagnetic launcher portion;

(2) providing a metallic fuse on the rear of the projectile which will initiate the formation of an arc and form a plasma armature;

(3) seeding the propellant with chemicals that will form a lower resistance arc; and (4) using an arc which results from the high voltage developed across the inductive energy storage means 24 to initiate breakdown within the electromagnetic launcher portion bore.

While the present invention has been described in terms of what is at present believed to be the preferred embodiment, it will be apparent to those skilled in the art that various changes or modifications may be made without departing from the invention. It is therefore intended that the appended claims cover all such changes and modifications which occur within the scope of the invention.

I claim:

1. An electromagnetic projectile launcher comprising:

a pair of generally parallel conductive rails lining an unrifled bore;

a source of electric current connected to said conductive rails;

a rifled barrel disposed adjacent to one end of said conductive rails and axially aligned with said bore;

means for electrically insulating said barrel and said conductive rails; and means for propelling a projectile through said rifled barrel thereby causing said projectile to spin and then for propelling said projectile through said unrifled bore, said propelling means including a chemical propellant, said propellant combustile for propelling said projectile through said rifled barrel and for initiating a plasma by electrical breakdown of gases resulting from combustion of said propellant, said plasma for conducting current between said conductive rails and for propelling said projectile along said rails.

* * * * *